United States Patent [19]

Ciabo

[11] 4,448,284

[45] May 15, 1984

[54] PEOPLE RESCUE DEVICE

[76] Inventor: Renzo Ciabo, P.zza Stefano Iacini, 26, Rome, Italy

[21] Appl. No.: 352,412

[22] Filed: Feb. 26, 1982

[51] Int. Cl.[3] ..... A62B 1/06

[52] U.S. Cl. ..... 182/234; 182/239; 188/184

[58] Field of Search ..... 182/234, 239, 5, 4, 182/3, 6, 7, 191–193; 188/184, 185, 188

[56] References Cited

U.S. PATENT DOCUMENTS

| | | | |
|---|---|---|---|
| 831,462 | 9/1906 | Noyer | 182/234 |
| 1,459,394 | 6/1923 | Gent | 188/185 |
| 1,777,354 | 10/1930 | Dina | 188/184 |
| 3,946,989 | 3/1976 | Tsuda | 188/185 |

*Primary Examiner*—R. P. Machado

*Assistant Examiner*—Alvin Chin-Shue

*Attorney, Agent, or Firm*—Millen & White

[57] ABSTRACT

This invention relates to a device for escaping from buildings in case of fires or other emergencies. The device enables persons to be rescued to leave the building by descending vertically along the external building walls. The device is made up of a closed casing provided with a hook to hook the same to an anchorage provided therefor near the upper windows or openings of the building. Inside the closed casing is a steel cable coiled on a reel that is connected, through an overgear, to a dynamic brake. A harness or safety belt is provided for being hooked to the free end of the steel cable that projects outwardly from the closed casing, and by means of this harness or safety belt the persons to be rescued leave the building by descending vertically.

9 Claims, 3 Drawing Figures

PEOPLE RESCUE DEVICE

BACKGROUND OF THE INVENTION

1. Field of the Invention

This invention relates to a device for effecting the rescue of people who are trapped on the upper floors of buildings following as a result fires or other emergencies.

2. Description of the Prior Art

Various prior art devices provide for a person being rescued to enjoy a reasonably controlled descent on the exterior of a building in the case of fire or other emergencies. These prior art devices are made up of a harness or safety belt secured to a casing wherein a cable is coiled on a reel that is connected to a braking apparatus. The free end of the cable has a hook to be hooked to an achorage provided therfor near the building windows. However, these prior devices are in some cases not fully operable in the desired manner, substantially for the reason that all these prior devices have to be secured to the user body and this fact provides the following disadvantages:

1. The device is heavy and cumbersome since the cable is coiled on a reel inside the same device, and for this reason it can be of hindrance during the descent. In addition, if an obstacle is encountered between the starting off point and that of arrival, the user cannot use his arms or his legs to free himself from the device, expecially if the user is a child, an aged person or an invalid.

2. The cable comes aut the device sliding near the users body, and since there is a relative movement between the cable and the user's body during the descent, the cable can become entangled with the user's clothing and/or wind the clothing in the device.

SUMMARY OF THE INVENTION

It is thus an object of this invention to provide a device for the rescue of people on the upper floors of buildings, when the emergency situations previously cited occur, which eliminates the drawbacks of the prior devices.

Essentially the device according to the invention comprises a closed casing having on its upper side a hook by means of which the closed casing can be connected to an achorage provided for near the building windows or openings. A reel is arranged inside the closed casing whereon a steel cable is coiled, and the reel is connected through an overgear to a dynamic brake. A free end of the cable projects outwardly from the lower side of said closed casing, and a harness or safety belt is adapted for being fastened to the same cable projecting free end.

DESCRIPTION OF THE PREFERRED EMBODIMENT

Figure 1:
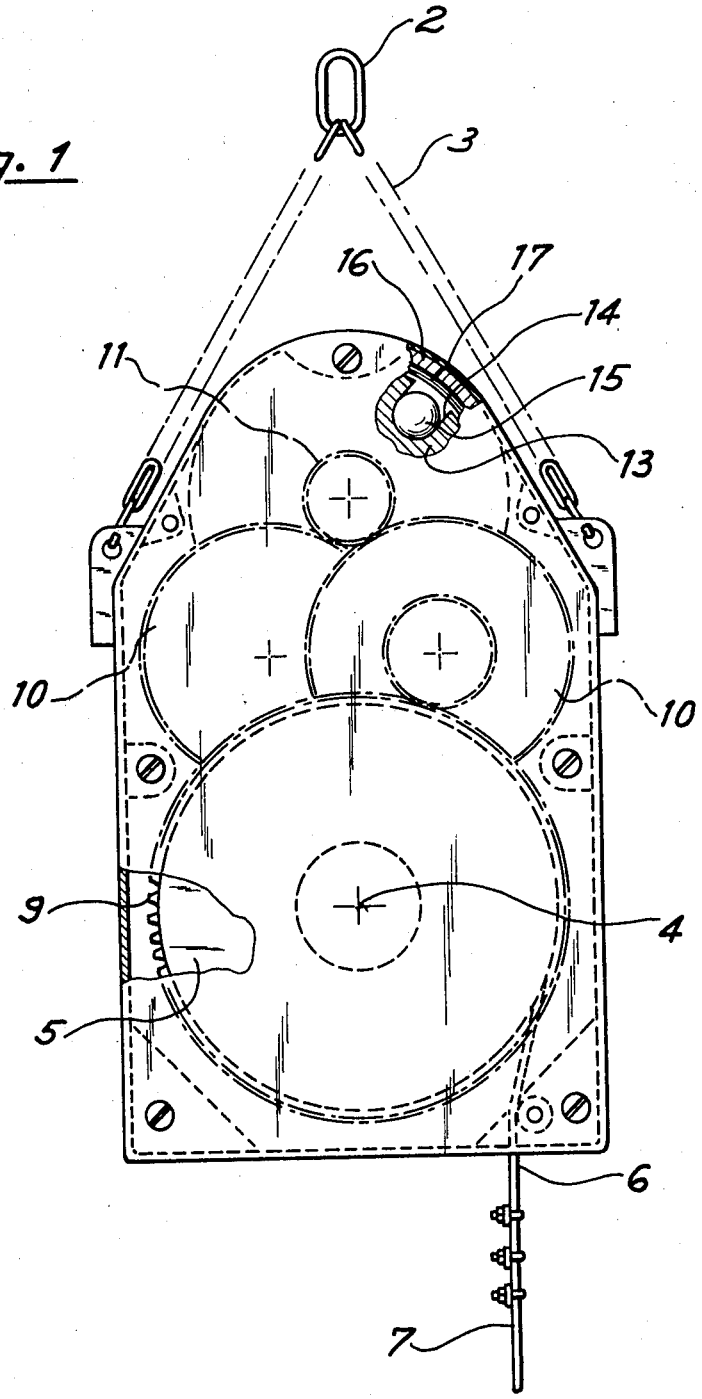
FIG. 1 is a diagrammatic front view of the rescue device according to the invention with its concealed parts shown in dotted-lines.
Figure 2:
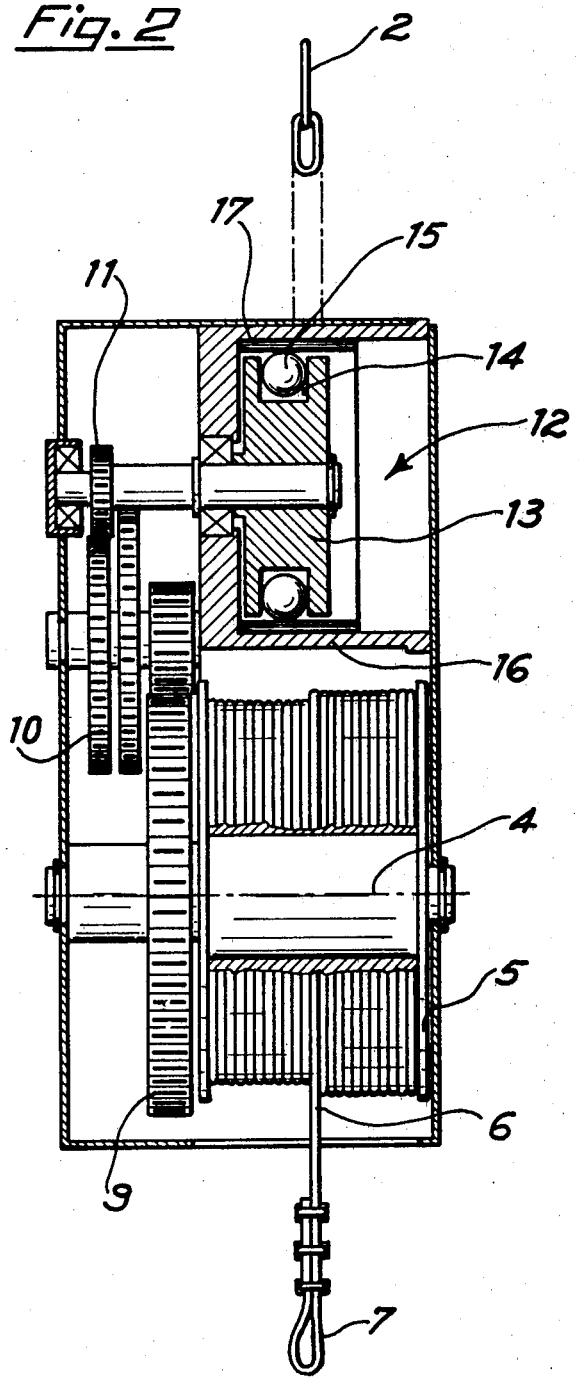
FIG. 2 is a diagrammatic side view, in partial cross-section, of the main components of the device.
Figure 3:
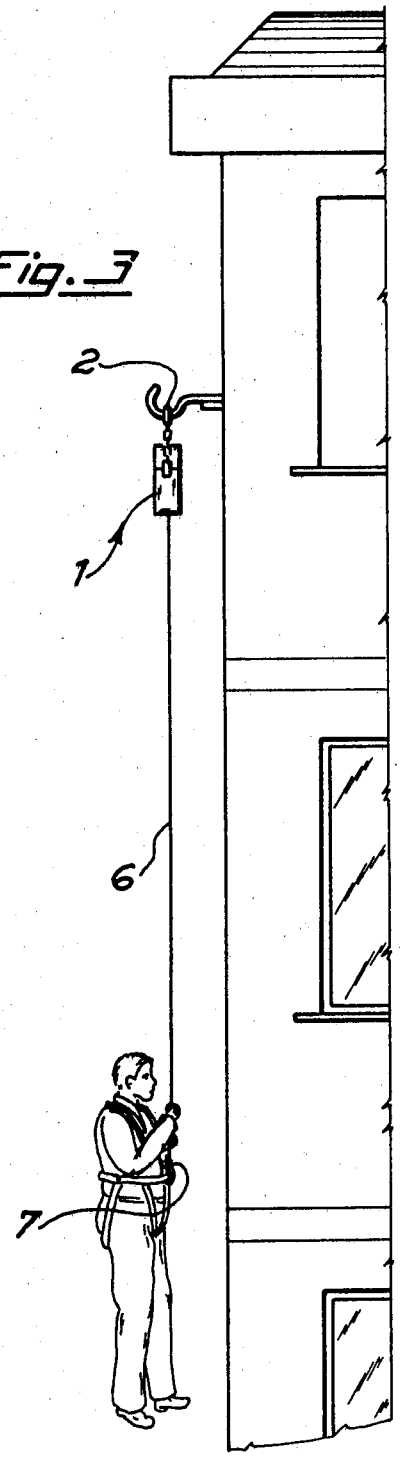
FIG. 3 is a fragmentary side view of the exterior portion of an upper floor of a building with the device of the instant invention illustrated as placed in use.

With reference to figures, the device includes a casing 1 on the upper side of which a hook 2 is secured to by means, i.e., of a chain 3.

Inside the casing 1, on an axis 4, a reel 5 is mounted on which a steel cable 6 is coiled. The steel cable is of a sufficient diameter to provide the function intended, and bears at its free end a ring 7. The steel cable 6 projects from the lower side of the casing 1, for example through an opening, and the reel 5 can be unwound by pulling downwardly the free end of the steel cable 6. A harness or a safety belt 8 that the user connects to his body can be firmly attached to the ring 7.

A gear 9 is fixed to reel 5, and when the cable 5 is pulled downwardly by a user's weight, the reel 5 rotates and the gear 9 sets into rotation an overgear made up of a gearing 10 that increases the rotational speed of a last gear 11 to which a dynamic brake 12 is connected.

The dynamic brake is made up of a movable wheel 13 having radial housings 14 with a steel sphere 15 arranged in each housing 14, and axially movable therein. The lateral surface 16 of the movable wheel is surrounded friction causing material 17.

When the user's weight sets the reel into rotation 5, the overgear increases the rotational speed of the movable wheel 13 and the centrifugal force thrusts the spheres 15 against the friction causing material 17. Naturally, the greater the speed of the movable wheel 13, the more the centrifugal force increases and the friction forces created by the sliding between the spheres 15 and the friction causing material 17 will then also increase.

In this way, the force generated by the weight of the user is transformed into the kinetic force of the movable wheel, and this kinetic force is dissipated by the friction forces of the spheres sliding against the friction causing material.

By means of this dynamic brake, the speed of descent of the user does not directly depend on the user's weight, but depends only on the rotational speed of the movable wheel 13.

The rescue device according to the present invention can also be placed outside the building windows or openings, and the harness or safety belts to be fastened to the user body placed inside the building, near the windows or openings.

A device for rewinding the steel cable to the reel can also be provided for so that the same rescue device can be used to rescue more than one person.

It is to be understood that many changes and modifications can be made to the shown embodiment, without departing from the spirit and scope of the present invention.

I claim:

1. In a device for slowly descending from a building, comprising a frame including means adapted for being connected to a location from which descent is to be initiated, a reel rotatably arranged in the frame and having a cable wound thereon with one end of the cable attached to the reel, and the other end projecting outwardly from the frame and with attaching means at the projecting end for latching thereonto for effecting a descent by causing unwinding of the cable from the reel, and brake means for regulating the speed of unwinding of the cable to regulate the speed of descent, the improvement wherein said brake means comprises:

gear means fixedly and coaxially attached within said frame to said reel for being rotated by rotating movement of said reel;

reducing overgear means comprising multiple gears interconnected within said frame to engage said gear means for being rotated thereby;

wheel means axially connected to one gear of said reducing overgear means for being rotated by rotation of said one gear, and having a plurality of radially arranged housings disposed about the circumference thereof, and a plurality of spherical steel bearings respectively arranged axially movable and rotatable in each one of said plural housings, wherein said reducing overgear means is adapted for causing rotation of said wheel means at a rate greater than the rotation of said reel, when being unwound, sufficient to cause outward axial movement of each one of said bearings; and a layer of friction causing material fixedly attached within said frame and surrounding the lateral surface of, and about the circumference of said wheel means and spaced therefrom at a distance less than the radius of said spherical steel bearings whereby upon rotation of said reel, said bearings are forced into direct contact with said layer of friction causing material to limit the speed of rotation of said reel in a continuously uniform manner.

2. A device as in claim 1 wherein said cable is a steel cable.

3. A device as in claim 1 further comprising a harness adapted for being attached to said attaching means, and for supporting a person therein.

4. A device as in claim 1 further comprising rewind means for rewinding said cable onto said reel after a descent operation.

5. A device as in claim 1 wherein said means adapted for being connected to a location from which descent is to be initiated comprises a hook.

6. A device as in claim 1 wherein said attaching means comprises a hook.

7. A device as in claim 3 wherein said attaching means is adapted for having at least one safety belt attached thereto.

8. A device as in claim 7 wherein said attaching means is adapted for having plural safety belts attached thereto.

9. In a device for slowly descending from a building comprising a frame including means adapted for being connected to a location from which descent is to be initiated, a reel rotatably arranged in the frame and having a cable wound thereon with one end of the cable attached to the reel, and the other end projecting outwardly from the frame and with attaching means at the projecting end for latching thereonto for effecting a descent by causing unwinding of the cable from the reel, and brake means for regulating the speed of unwinding of the cable to regulate the speed of descent, the improvement wherein: said cable is a steel cable having a hook and harness attached at the projecting end for supporting a person therein; said device further comprising rewind means for rewinding said cable onto said reel after a descent operation; and wherein said brake means comprises;

(1) gear means fixedly and coaxially attached within said frame to said reel for being rotated by rotating movement of said reel, (2) reducing overgear means comprising multiple gears interconnected within said frame to engage said gear means for being rotated thereby, (3) wheel means axially connected to one gear of said reducing overgear means for being rotated by rotation of said one gear, and having a plurality of radially arranged housings disposed about the circumference thereof, and a plurality of spherical steel bearings respectively arranged axially movable and rotatable in each one of said plural housings, wherein said reducing overgear means is adapted for causing rotation of said wheel means at a rate greater than the rotation of said reel, when being unwound, sufficient to cause outward axial movement of each one of said bearings, and (4) a layer of friction causing material fixedly attached wherein said frame and surrounding the lateral surface of, and about the circumference of said wheel means and spaced therefrom at a distance less than the radius of said spherical steel bearings, whereby upon rotation of said reel, said bearings are forced into direct contact with said layer of friction causing material to limit the speed of rotation of said reel in a continuously uniform manner.

* * * * *